US007909644B1

(12) United States Patent
Li et al.

(10) Patent No.: US 7,909,644 B1
(45) Date of Patent: Mar. 22, 2011

(54) CARD EDGE CONNECTOR ASSEMBLY WITH CARDS INSERTED THEREINTO ALONG DIFFERENT DIRECTIONS

(75) Inventors: Hua Li, Kunshan (CN); Zhen-Hua Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/834,912

(22) Filed: Jul. 13, 2010

(51) Int. Cl.
*H01R 13/60* (2006.01)

(52) U.S. Cl. ..... 439/541.5; 439/631

(58) Field of Classification Search ..... 439/541.5, 439/630, 631
See application file for complete search history.

(56) References Cited

U.S. PATENT DOCUMENTS 6,821,144 B2 * 11/2004 Choy ..... 439/541.5
7,086,895 B1 * 8/2006 Ting ..... 439/541.5
7,338,307 B2 3/2008 Zhang et al.
7,614,899 B2 * 11/2009 Zhu et al. ..... 439/325
7,794,259 B2 * 9/2010 Zhu et al. ..... 439/327
2004/0029438 A1 * 2/2004 Choy ..... 439/541.5
2009/0163055 A1 * 6/2009 Zhu ..... 439/83

FOREIGN PATENT DOCUMENTS

CN 200720003525.6 1/2008

* cited by examiner

*Primary Examiner* — James Harvey
(74) *Attorney, Agent, or Firm* — Andrew C. Cheng; Wei Te Chung; Ming Chieh Chang

(57) ABSTRACT

A card edge connector assembly is provided with a first connector, a second connector and a printed circuit board (PCB). The first/second connector respectively comprises a first/second insulative housing with a plurality of first/second terminals mounted therein. The first/second insulative housing has a first/second upper wall, a first/second lower wall and a first/second mating cavity defined therebetween for receiving the first/second memory module therein. The PCB defines a first and a second solder regions at a top face thereof, on which the first and second terminals are respectively soldered. The first and second memory modules are respectively inserted into the first and second mating cavities along different directions so as to avoid interference between the memory modules during the assembling process.

19 Claims, 6 Drawing Sheets

CARD EDGE CONNECTOR ASSEMBLY WITH CARDS INSERTED THEREINTO ALONG DIFFERENT DIRECTIONS

BACKGROUND OF THE INVENTION

1. Field of the Invention

The present invention relates to a card edge connector assembly, and more particularly to a card edge connector assembly with two cards inserted thereinto along different directions.

2. Description of the Related Art

U.S. Pat. No. 7,338,307 issued to Zhang et al. on Mar. 4, 2008 discloses a card edge connector assembly comprising an upper connector and a lower connector stacked together and offsetting with each other along a front-to-rear direction for respectively receiving a card therein. The lower connector is configured into a sink type and located under the upper connector thereby both connectors can be soldered onto a same side of a printed circuit board. However, when assembling the cards, the lower card must be assembled thereinto before the upper card, and the lower card interferes with the upper connector during the assembling process, which is not convenient for the user.

China Utility Patent No. 200720003525.6 discloses a card edge connector assembly comprising an upper connector a lower connector respectively located at opposite sides of a printed circuit board and configured as a mirror image regarding to the printed circuit board. The upper connector defines a central slot therein for receiving an upper card in an upside-down status, and the lower connector defines a central slot therein for receiving a lower card in a downside-up status, therefore the two cards can be assembled individually. However, the upper connector and the lower connector are soldered onto different sides of the printed circuit board, which will increase the height of the card edge connector assembly. Obviously, an improved card edge connector assembly is highly desired to overcome the aforementioned problem.

SUMMARY OF THE INVENTION

Accordingly, an object of the present invention is to provide a card edge connector assembly for easily assembling cards therein.

In order to achieve the object set forth, a card edge connector, adapted for stacking with a first card edge connector including a first insulative housing with a plurality of first upper terminals and first lower terminals mounted therein and a first central slot defining a first insertion direction for receiving a memory module therein, said first upper terminals and lower terminals respectively forming contacting portions projecting into the first central slot, includes a second insulative housing defining a second central slot for receiving another memory module therein. Second upper terminals and lower terminals are mounted on the second insulative housing and respectively form contacting portions projecting into the second central slot. A distance between the contact portions of the first upper terminals and second upper terminals is larger than that between the contact portions of the first lower terminals and the second lower terminals under a condition that the card edge connector is stacked with the first card edge connector with both central slots facing forwardly.

In order to achieve the object set forth, a card edge connector assembly adapted for receiving a first and a second memory modules therein includes a first card edge connector and a second card edge connector located under the first card edge connector. The first card edge connector includes a first insulative housing mounting a first terminal group therein. The first insulative housing has an upper wall, a lower wall and a first central slot located therebetween for receiving the first memory module therein. The first terminal group defines a first mounting face on which the first card edge connector is mounted. The second card edge connector includes a second insulative housing having an upper wall, a lower wall and a second central slot located therebetween for receiving the second memory module therein. The second terminal group defines a second mounting face on which the second card edge connector is mounted, and said first mounting face and second mounting face are coplanar with each other. The first and second central slots respectively define receiving spaces extending along different directions so as to avoid interference between the first and second memory modules during the assembling process.

Other objects, advantages and novel features of the invention will become more apparent from the following detailed description of the present embodiment when taken in conjunction with the accompanying drawings.

DETAILED DESCRIPTION OF THE INVENTION

Figure 1:
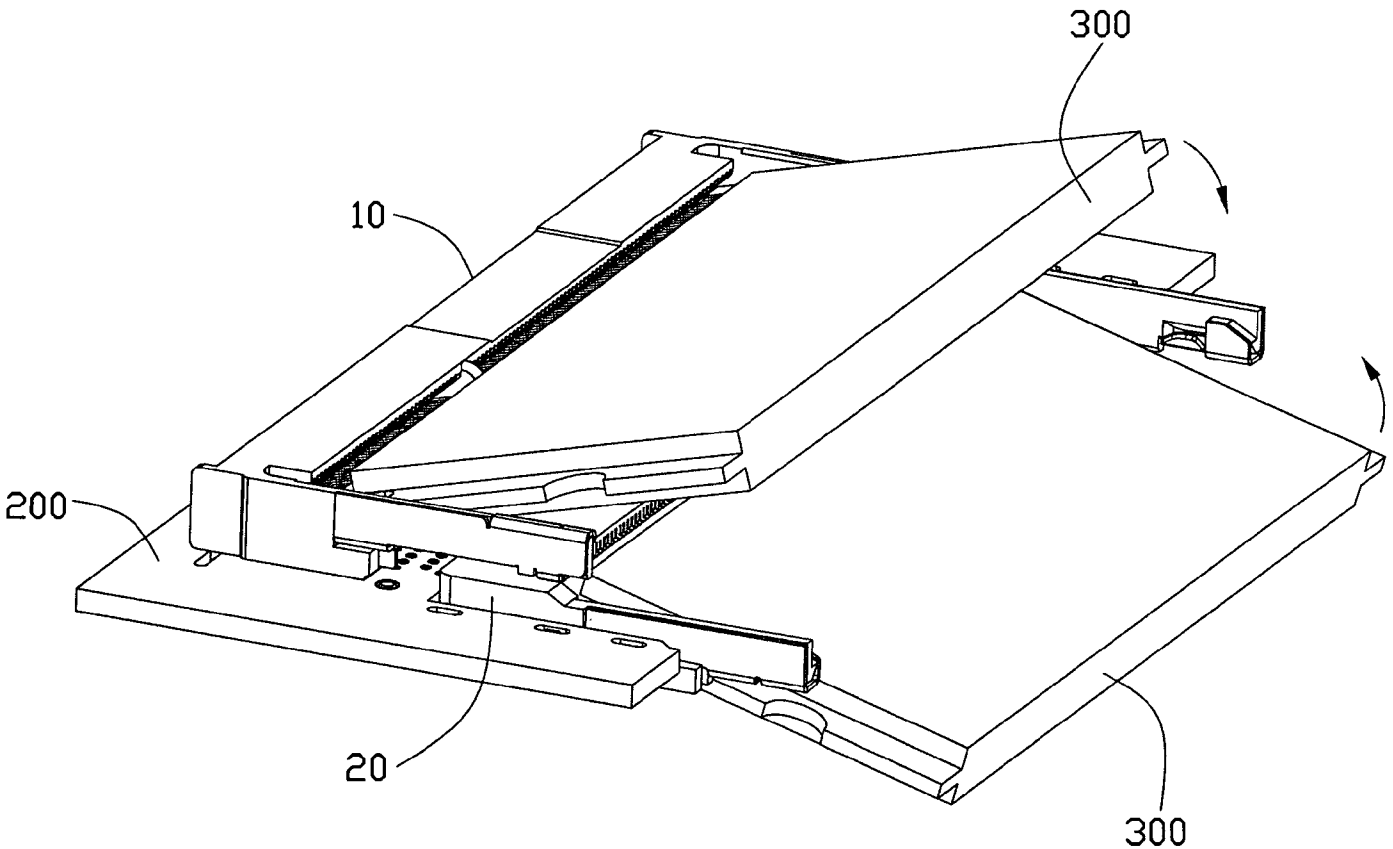
FIG. 1 is a perspective view of a card edge connector assembly mounted onto a printed circuit board, wherein a pair of cards are respectively assembled onto the card edge connector assembly in an initial status.
Figure 2:
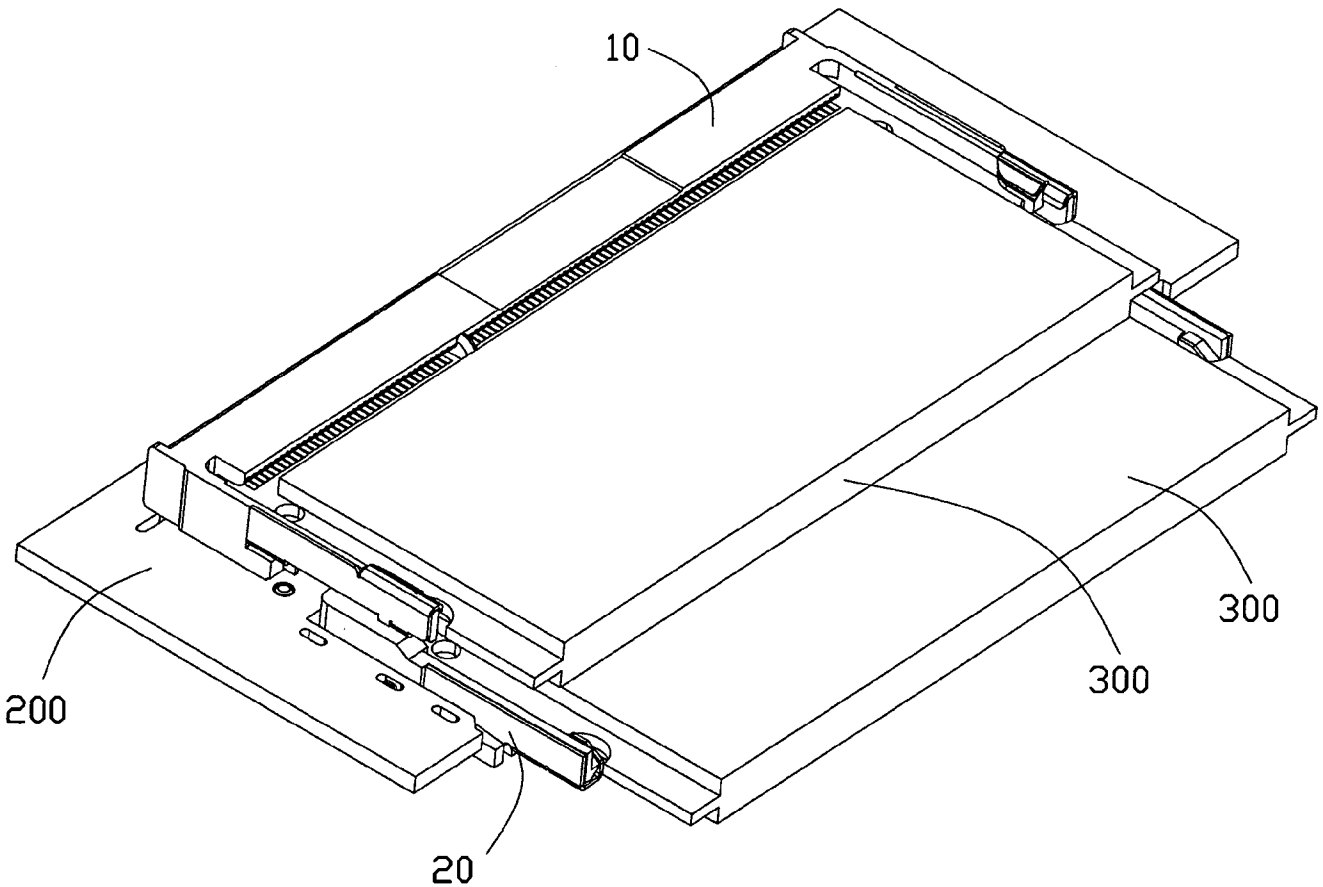
FIG. 2 is a perspective view of the card edge connector assembly mounted onto the printed circuit board, wherein the pair of cards are respectively assembled onto the card edge connector assembly in a final status.

Reference will now be made to the drawing figures to describe a preferred embodiment of the present invention in detail. Referring to FIGS. 1 and 2, a card edge connector assembly made according to the preferred embodiment of the present invention is provided and comprises a first card edge connector 10 and a second card edge connector 20 mounted onto a printed circuit board 200, wherein the second card edge connector 20 is located under the first card edge connector 10 and in front of the first card edge connector 10 along a front-to-rear direction.

Figure 3:
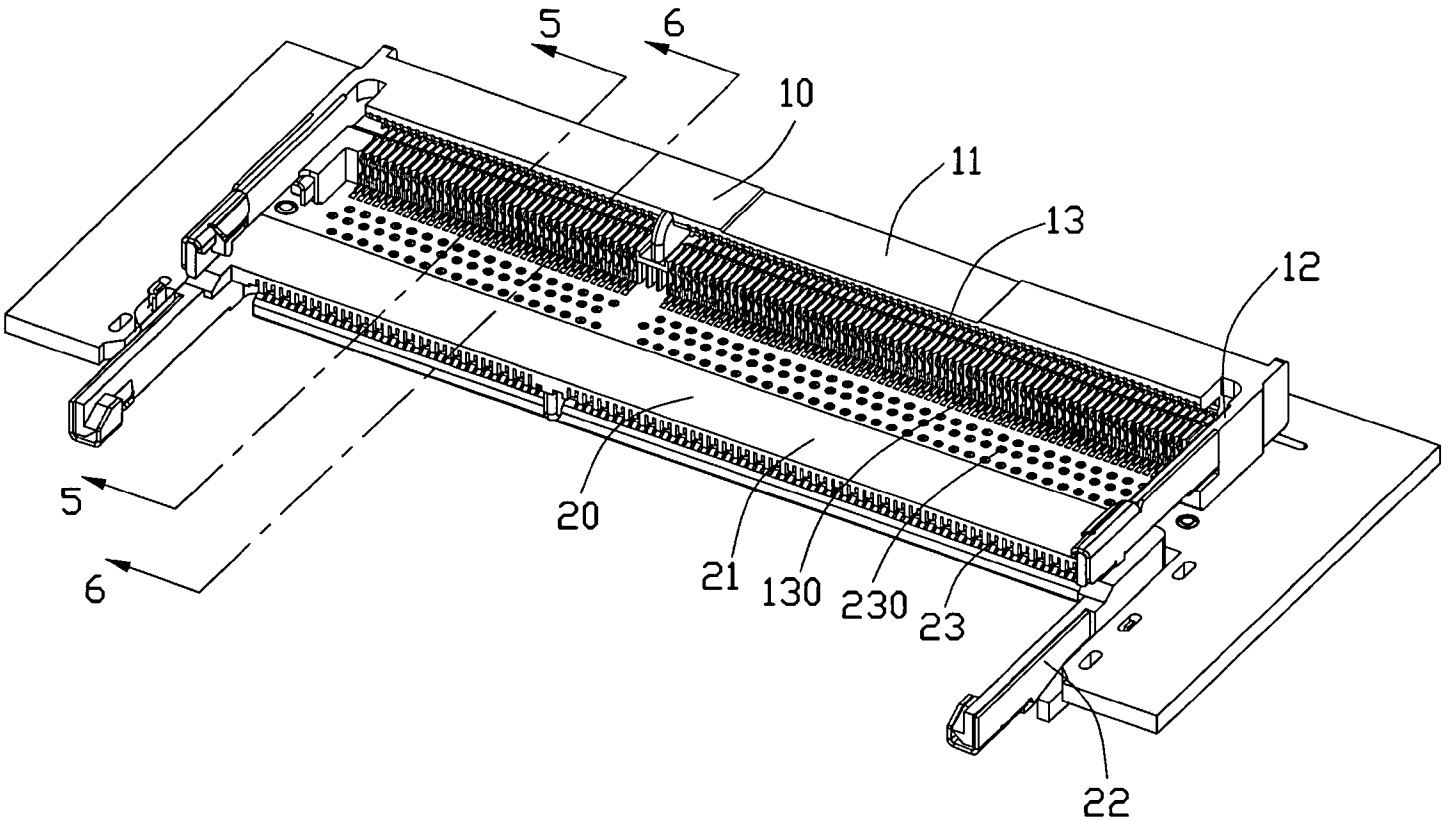
FIG. 3 is a perspective view of the card edge connector assembly mounted onto the printed circuit board.
Figure 4:
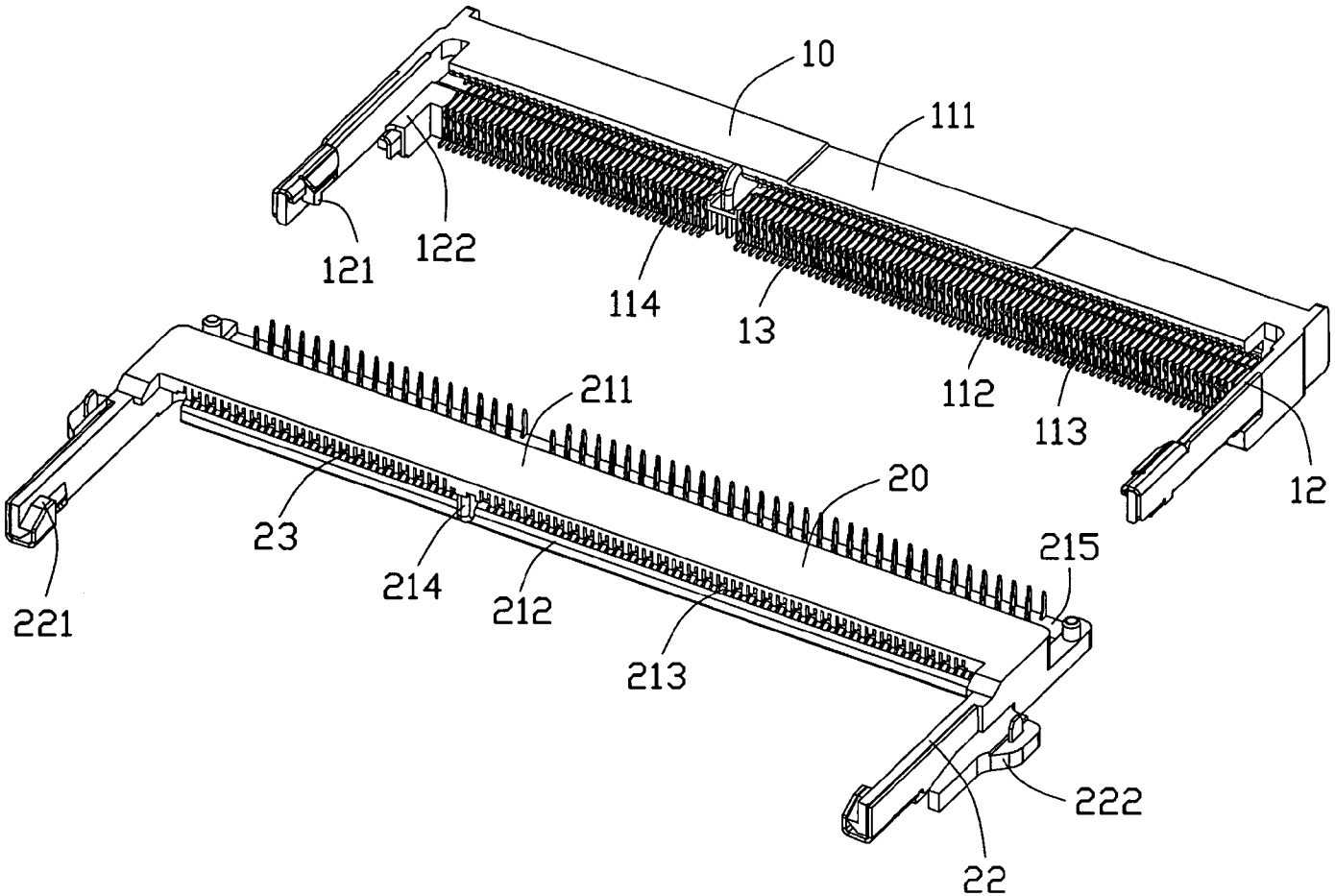
FIG. 4 is an exploded perspective view of the card edge connector assembly shown in FIG. 3.

Referring to FIGS. 3 and 4, the first card edge connector 10 comprises an elongated insulative housing 11 and a pair of arms 12 extending from opposite sides of the insulative housing 11. The insulative housing 11 comprises an upper wall 111 and a lower wall 112, on which a plurality of terminal grooves are defined for receiving conductive terminals 13, and between which a central slot 113 is defined for receiving a memory module 300 therein. A key 114 is formed in the central slot 113 adjacent to one arm 12 for cooperating with a notch defined in a front end of the memory module 300. A supporting platform 122 extends forward from each end of the central slot 113 and connects with the corresponding arm 12 for providing a supporting face when the memory module 300 is assembled. Further more, a locking portion 121 which is configured into an inverted L shape is formed at a distal end of each arm 12 for locking with the memory module 300. As a front face of the upper wall 111 is located behind a front face of the lower wall 112, the central slot 113 therebetween defines a receiving space facing upwardly.

The second card edge connector 20 is a sink type and comprises an elongated insulative housing 21 and a pair of arms 22 disposed at opposite sides thereof. The insulative housing 21 comprises an upper wall 211, a lower wall 212, a central slot 213 between the upper and lower walls, and a key 214 formed in the central slot 213. The key 214 is in alignment with the key 114 along the rear-to-front direction. As a front face of the upper wall 211 is located behind a front face of the lower wall 212, the central slot 213 therebetween defines a receiving space facing downwardly, which is different from the receiving space of the first card edge connector 10. An extending section 215 extends rearward from the lower wall 212 of the insulative housing 21 for retaining conductive terminals 23 mounted in the upper and lower walls 211, 212. Each terminal 23 forms a solder portion extending away from the extending section 215 and toward the upper wall 211. A retaining portion 222 is formed at a lateral side of each arm 22 for securing the second card edge connector 20 onto the printed circuit board 200. Moreover, a locking portion 221 is formed at a distal end of each arm 22 for locking with the memory module 300.

Figure 5:
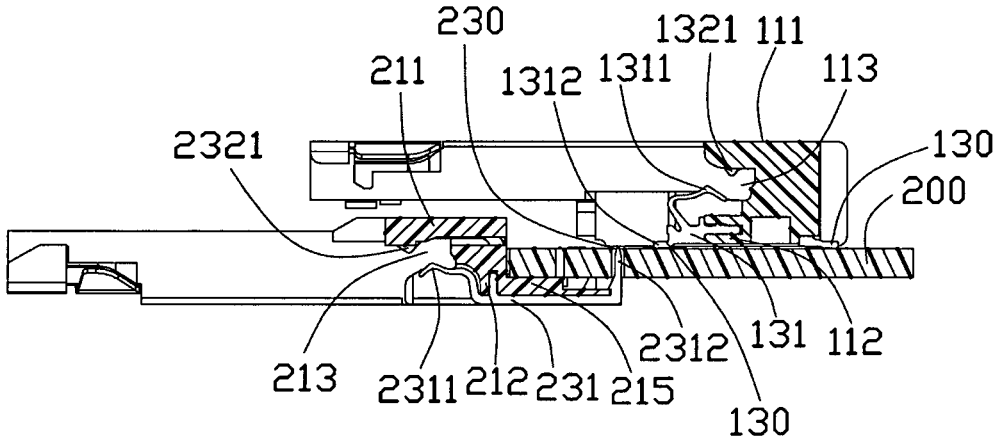
FIG. 5 is a cross-sectional view of the card edge connector assembly shown in FIG. 3 along line 5-5.
Figure 6:
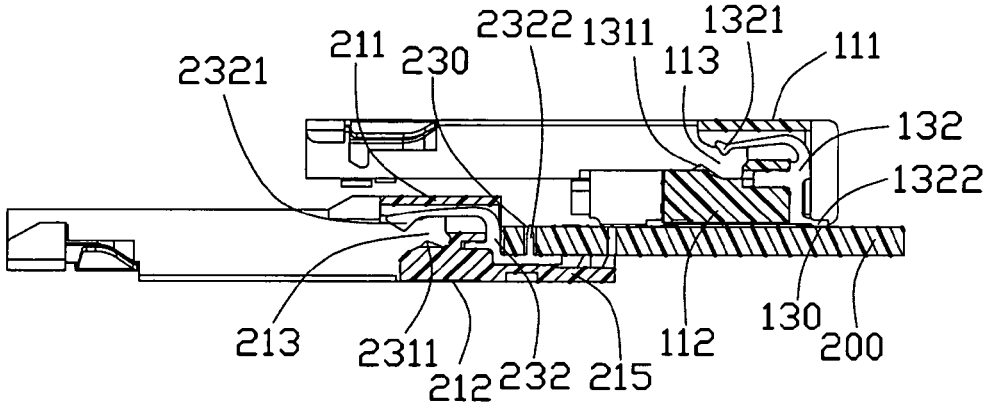
FIG. 6 is a cross-sectional view of the card edge connector assembly shown in FIG. 3 along line 6-6.

Referring to FIG. 4 to FIG. 6, the terminals 13 in the first card edge connector comprises first upper terminals 132 retained in the upper wall 111 and first lower terminals 131 retained in the lower wall 112. Each first upper and lower terminals 132, 131 comprises contact portions 1321, 1311 projecting into the central slot 113 and solder portions 1322, 1312 extending downwardly. The contact portion 1321 of each first upper terminal 132 is located behind the contact portion 1311 of each first lower terminal 131, i.e. the contact portion 1321 is closer to an inner side of the central slot 113 than the contact portion 1311. The memory module 300 is inserted into the central slot 113 in an upside-down manner and conductive pads on a lower face of the memory module 300 are firstly engaging with the contact portions 1311 of the first lower terminals 131 at an initial status, then conductive pads on an upper face of the memory module 300 are engaging with the contact portions 1321 of the first upper terminals 132. The solder portions 1322, 1312 are SMT (surface mounting technology) type and respectively mounted onto a first mounting face 130 on an upper side of the printed circuit board 200.

The terminals 23 in the second card edge connector 20 comprises second upper terminals 232 retained in the upper wall 211 and second lower terminals 231 retained in the lower wall 212. Each second upper and lower terminals 232, 231 comprises contact portions 2321, 2311 projecting into the central slot 213 and solder portions 2322, 2312 extending upwardly. The contact portion 2321 of each second upper terminal 232 is located in front of the contact portion 2311 of each second lower terminal 231, i.e., the contact portion 2311 of each second lower terminal 231 is closer to an inner side of the central slot 213 than the contact portion 2321. It should be pointed out that as the terminal arrangement of the first and second card edge connectors are different, a distance between the contact portion 1321 of the first upper terminal 132 and the contact portion 2321 of the second upper terminal 232 is larger than that between the contact portion 1311 of the first lower terminal 131 and the contact portion 2311 of the second lower terminal 231.

The memory module 300 is inserted into the central slot 213 in a downside-up manner, therefore it can not interfere with the first card edge connector 10 during the assembling process, that is to say, the two memory modules 300 can be separately assembled onto the card edge connector assembly individually, which is convenient for the user to operate. The conductive pads on the upper face of the memory module 300 are firstly engaging with the contact portions 2321 of the second upper terminals 232 at the initial status, then conductive pads on the lower face of the memory module 300 are engaging with the contact portions 2311 of the second lower terminals 231.

Referring to FIG. 3, the solder portions 2322, 2312 of the second upper terminal 232 and the second lower terminal 231 are configured as pin type configuration and extend upward from the extending section 215 so as to be soldered onto a second mounting face 230 defined on the upper side of the printed circuit board 200. As the first mounting face 130 and the second mounting face 230 are coplanar with each other and commonly defined at a same side of the printed circuit board 200, the soldering process can be accomplished efficiently.

The first card edge connector 10 is located on the upper side of the printed circuit board 200 where the first mounting face 130 is defined, and the second card edge connector 20 is located on the lower side of the printed circuit board 200 with the pin shaped solder portion 2312, 2322 passing through the printed circuit board 200 and soldered on the second mounting face 230 which is in front of the first mounting face 130. The retaining portions 222 attach to the lower side of the printed circuit board 200 so as to secure the second card edge connector 20 on the printed circuit board 200. The extending portion 215 engages with the lower side of the printed circuit board 200 and the upper wall 221 of the second card edge connector 20 is located a little higher than the upper side of the printed circuit board 200, hence the thickness of the printed circuit board 200 can be absorbed by the lower card edge connector 20 and the height of the card edge connector assembly can be reduced. It is also noted that because the instant invention requires two modules are inserted into the corresponding two connectors in opposite directions, those two connectors are optimally configured to be one standard type and one reverse type as disclosed in U.S. Pat. No. 5,882,211 for simplifying the circuit trace arrangement on the corresponding mother board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector adapted for stacking with a first card edge connector including a first insulative housing with a plurality of first upper terminals and first lower terminals mounted therein and a first central slot defining a first insertion direction for receiving a memory module therein, said first upper terminals and lower terminals respectively forming contacting portions projecting into the first central slot, comprising:

a second insulative housing defining a second central slot for receiving another memory module therein; and second upper terminals and lower terminals mounted on the second insulative housing and respectively forming contacting portions projecting into the second central slot;

wherein a distance between the contact portions of the first upper terminals and second upper terminals is larger than that between the contact portions of the first lower terminals and the second lower terminals under a condition that the card edge connector is stacked with the first card edge connector with both central slots facing forwardly.

2. The card edge connector as described in claim 1, wherein the second insulative housing forms a pair of arms at opposite ends thereof and each arm forms a retaining portion projecting from a lateral side thereof.

3. The card edge connector as described in claim 2, wherein the second insulative housing forms an extending portion projecting out of the insulative housing for retaining solder portions of the second upper and lower terminals, and said extending portion and the retaining portions are located at a same side of the second central slot.

4. The card edge connector as described in claim 3, wherein the second central slot also defines a second insertion direction which is opposite to the first insertion direction.

5. A card edge connector assembly adapted for receiving a first and a second memory modules therein, comprising:

a first card edge connector including a first insulative housing mounting a first terminal group therein, the first insulative housing having an upper wall, a lower wall and a first central slot located therebetween for receiving the first memory module therein, the first terminal group defining a first mounting face on which the first card edge connector is mounted;

a second card edge connector located under the first card edge connector and including a second insulative housing having an upper wall, a lower wall and a second central slot located therebetween for receiving the second memory module therein, the second terminal group defining a second mounting face on which the second card edge connector is mounted, and said first mounting face and second mounting face being coplanar with each other;

wherein the first and second central slots respectively define receiving spaces extending along different directions so as to avoid interference between the first and second memory modules during the assembling process.

6. The card edge connector assembly as described in claim 5, is mounted onto an upper face of a printed circuit board, on an upper face of which the first and second mounting faces are defined.

7. The card edge connector assembly as described in claim 6, wherein the second card edge connector is located in front of the first card edge connector along a front-to-rear direction after the first and second card edge connectors are mounted onto the printed circuit board.

8. The card edge connector assembly as described in claim 7, wherein the second terminal group includes second upper terminals and lower terminals respectively mounted on the upper wall and lower wall of the second insulative housing, each of the second upper and lower terminals comprise contact portions projecting into the second central slot and solder portions extending from the lower wall side to the upper wall side so as to be mounted onto the second mounting face.

9. The card edge connector assembly as described in claim 8, wherein the second insulative housing defines an extending portion for holding the solder portions of the second upper and lower terminals, and said extending portion engages with a lower face of the printed circuit board.

10. The card edge connector assembly as described in claim 9, wherein the first terminal group includes first upper terminals and lower terminals respectively mounted on the upper wall and lower wall of the first insulative housing, each of the first upper and lower terminals comprise contact portions projecting into the first central slot, a distance between the contact portions of the first upper terminals and second upper terminals is larger than that between the contact portions of the first lower terminals and the second lower terminals.

11. The card edge connector assembly as described in claim 10, wherein both of the first and second insulative housings have arms at opposite ends thereof, each arm of the second insulative housing forms a retaining portion projecting sideward so as to attach to the lower face of the printed circuit board.

12. The card edge connector assembly as described in claim 11, wherein the first and second central slots respectively form a first and a second key in alignment with each other.

13. An electrical connector assembly for use with a printed circuit board having opposite first and second board surfaces around a notch thereof, comprising:

an elongated first housing defining a first mounting surface facing toward a first vertical direction for mounting to the first board surface of the printed circuit board in the first vertical direction, and a first central slot extending in the first housing along a longitudinal direction perpendicular to said first vertical direction;

a plurality of first contacts disposed in the first housing and by two sides of the first central slot;

an elongated second housing defining a second mounting surface facing toward a second vertical direction opposite to said first vertical direction for mounting to the second board surface of the printed circuit board in a second vertical direction, and a second central slot extending along the longitudinal direction in the second housing;

a plurality of second contacts disposed in the second housing and by two sides of the second central slot;

said first housing and said second housing essentially directly and intimately confronting each other vertically in a bottom-to-bottom manner while with an offset therebetween in at least a partially overlapping manner along a front-to-back direction perpendicular to both said first vertical direction and said longitudinal direction; and the first central slot being configured for allowing a module to be initially forwardly and angularly inserted thereinto in a normal manner with regard to the first housing and successively rotated essentially in the first vertical direction until reaching a final horizontal position parallel to the printed circuit board; the second central slot being configured for allowing another module to be initially forwardly and angularly inserted thereinto in an upside down manner with regard to the second housing and successively rotated in essentially in the second vertical direction until reaching the horizontal position.

14. The electrical connector assembly as claimed in claim 13, wherein said one of the first housing and the second housing located behind the other, is configured for being adapted to be received in the notch of the printed circuit board.

15. The electrical connector assembly as claimed in claim 14, wherein each of said first housing and second housing is further equipped with a pair of latching arms at two opposite ends thereof, and said two opposite ends of said one of the first housing and the second housing vertically confronts and is overlapped with the latching arms of the other of the first housing and the second housing.

16. The electrical connector assembly as claimed in claim 15, wherein the latching arms of said one of the first housing and the second housing is positioned and dimensioned for being located outside of the notch along said front-to-back direction while the latching arms of the other of the first housing and the second housing is positioned and dimensioned for being located inside of the notch along the front-to-back direction in a top view.

17. The electrical connector assembly as claimed in claim 14, wherein said one of the first housing and the second housing is the second housing.

18. The electrical connector assembly as claimed in claim 14, wherein a portion of said one of the first housing and the second housing is dimensioned for extending beyond the first board surface of the printed circuit board in the second direction when mounting to the second board surface.

19. The electrical connector assembly as claimed in claim 13, wherein the first housing is of a so-called standard type connector while the second housing is of a so-called reverse type connector.

* * * * *